US008714356B2

(12) United States Patent
Liao et al.

(10) Patent No.: US 8,714,356 B2
(45) Date of Patent: May 6, 2014

(54) CUSHIONING AIR BAG WITH AUTOMATICALLY ADJUSTABLE CLAMPING PRESSURE

(75) Inventors: Yaw-Shin Liao, New Taipei (TW); Kao-Hsiung Liao, New Taipei (TW); Ting-Yu Liao, New Taipei (TW)

(73) Assignee: Yaw-Shin Liao, New Taipei (TW)

( * ) Notice: Subject to any disclaimer, the term of this patent is extended or adjusted under 35 U.S.C. 154(b) by 42 days.

(21) Appl. No.: 13/571,907

(22) Filed: Aug. 10, 2012

(65) Prior Publication Data

US 2013/0048529 A1 Feb. 28, 2013

(30) Foreign Application Priority Data

Aug. 26, 2011 (TW) ..... 100130760 A

(51) Int. Cl.
*B65D 81/03* (2006.01)
*B65D 30/24* (2006.01)

(52) U.S. Cl.
USPC ..... 206/522; 383/3

(58) Field of Classification Search
USPC ..... 206/522; 383/3
See application file for complete search history.

(56) References Cited

U.S. PATENT DOCUMENTS

| | | | | |
|---|---|---|---|---|
| 6,629,777 | B2 * | 10/2003 | Tanaka et al. | 383/3 |
| 7,410,057 | B2 * | 8/2008 | Yoshifusa | 206/522 |
| 7,422,109 | B2 * | 9/2008 | Yoshifusa | 206/522 |
| 7,631,762 | B2 * | 12/2009 | Liao et al. | 206/522 |
| 2004/0149618 | A1 * | 8/2004 | Otaki et al. | 206/521 |
| 2008/0107362 | A1 * | 5/2008 | Yoshifusa | 383/3 |
| 2009/0050509 | A1 * | 2/2009 | Liao et al. | 206/522 |
| 2009/0166238 | A1 * | 7/2009 | Dickinson | 206/522 |

* cited by examiner

*Primary Examiner* — Bryon Gehman
(74) *Attorney, Agent, or Firm* — Rabin & Berdo, P.C.

(57) ABSTRACT

A cushioning air bag with automatically adjustable clamping pressure includes an air cylinder sheet and an adjustable air sac sheet, where the air cylinder sheet includes a first air valve and a plurality of air cylinders, one end of the first air valve is positioned in the plurality of air cylinders, and an adjustable air sac sheet, includes a plurality of cushioning adjustment zones attached to wall surfaces of the plurality of air cylinders, a bag is formed when the air cylinder sheet and adjustable air sac sheet are filled with air, an accepting space is included among the plurality of cushioning zones positioned in the bag, used for clamping a different size of object when the object is received in the accepting space.

17 Claims, 12 Drawing Sheets

CUSHIONING AIR BAG WITH AUTOMATICALLY ADJUSTABLE CLAMPING PRESSURE

CROSS-REFERENCES TO RELATED APPLICATIONS

This non-provisional application claims priority under 35 U.S.C. §119(a) on Patent Application No(s). 100130760 filed in Taiwan, R.O.C. on 2011 Aug. 26, the entire contents of which are hereby incorporated by reference.

TECHNICAL FIELD

The present invention relates to an air bag structure, and more particularly to an air cushioning bag that clamping pressure thereof can be adjusted automatically.

BACKGROUND

Currently, handbags for carrying articles or outer packages for receiving mailed objects, such as general plastic bags, paper bags, plastic mail bags, boxes, or the like, are all unable to provide good protection for packed objects. For example, mailed objects such as fragile articles or glass are easily damaged during transportation due to the compression caused from the stacking of mailed packages, no matter what kind of material they are made of. In particular, objects in paper or plastic mail bags are apt to be damaged due to collision or compression, to mailed objects, the protection capability of these mail tools are the worst.

To avoid collision, there also are paper boxes used to pack mailed objects. Since paper boxes are all almost cubic, and the surfaces thereof are rather rigid, they can provide a little more protection for contents. However, not all objects are cubic and large enough to fill up the paper box, due to a larger inner space thereof. It is inevitable that the object will roll around in the box, and collide with the box, causing damage during transportation when the object is placed in the box.

Multiple bubble granules might be placed in a paper box for the protection of a packed object from rolling around and being collided, but they cannot protect it wholly and safely.

SUMMARY

To improve air protection structures, allowing them to have safe protection capability, the present invention is proposed.

The present invention proposes a cushioning air bag with automatically adjustable clamping pressure, including an air cylinder sheet and an adjustable air sac sheet, where the air cylinder sheet includes a first air valve and a plurality of air cylinders, one end of the first air valve is positioned in the plurality of air cylinders, and the adjustable air sac sheet, includes a plurality of cushioning adjustment zones attached to wall surfaces of the plurality of air cylinders, a bag is formed when the air cylinder sheet and adjustable air sac sheet are filled with air, an accepting space is included among the plurality of cushioning zones positioned in the bag, used for clamping a different size of object when the object is received in the accepting space.

The present invention may receive different sizes of objects through the accepting space of the adjustable air sac sheet after air filling, and uses the air cylinder sheet and adjustable air sac sheet to have double protection, capable of achieving the multiple packing bag specifications only by one single air bag structure, i.e. one single air cylinder sheet and one single adjustable air sac sheet can provide multiple different sizes of bag accepting space. In addition, the present can increase cushioning effect and the environmental protection effect of reducing the use of packing bags.

BRIEF DESCRIPTION OF THE DRAWINGS

The present invention can be more fully understood by reference to the following description and accompanying drawings, wherein.

DETAILED DESCRIPTION

Figure 1:
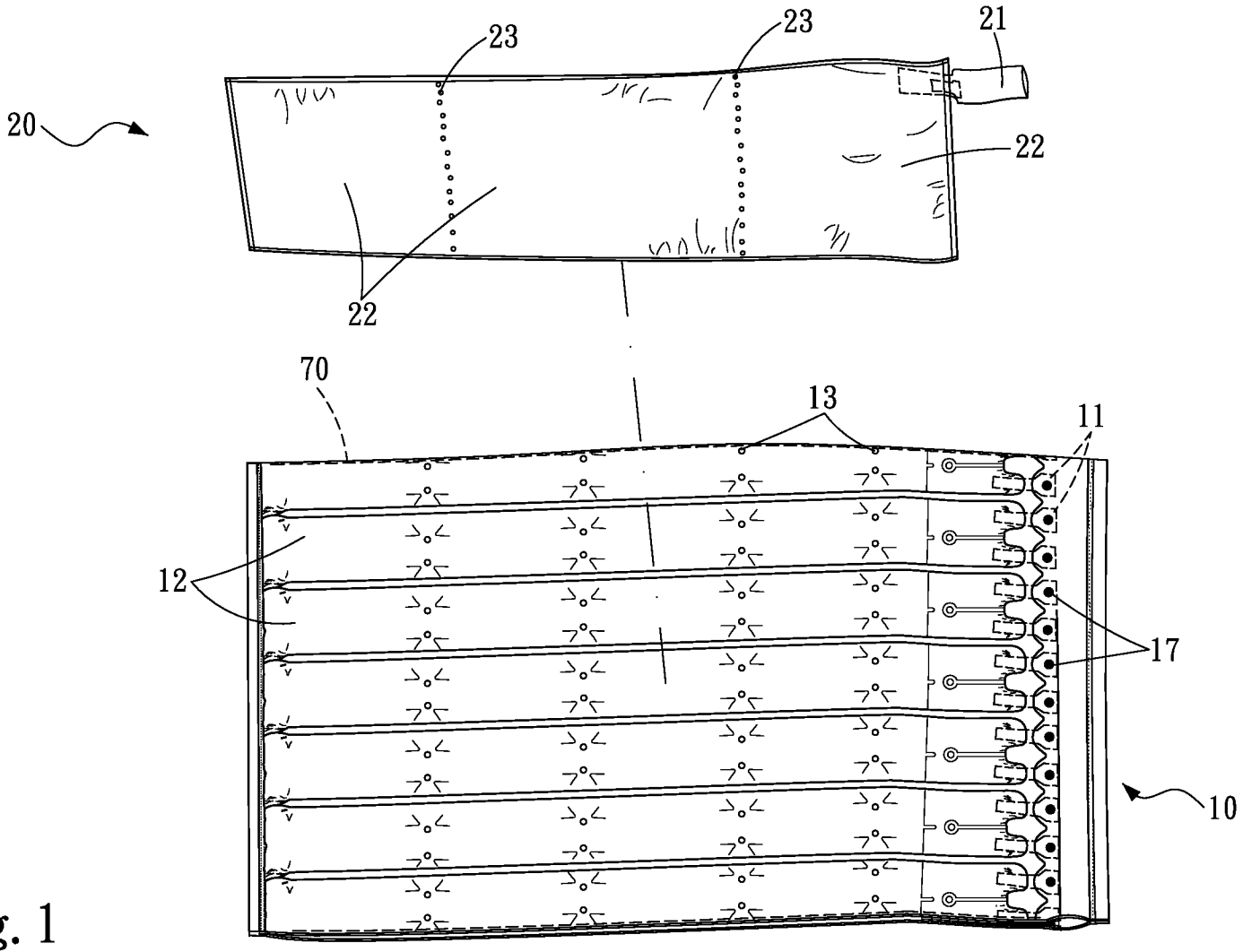
FIG. 1 is a top view of a first embodiment according to the present invention.
Figure 2:
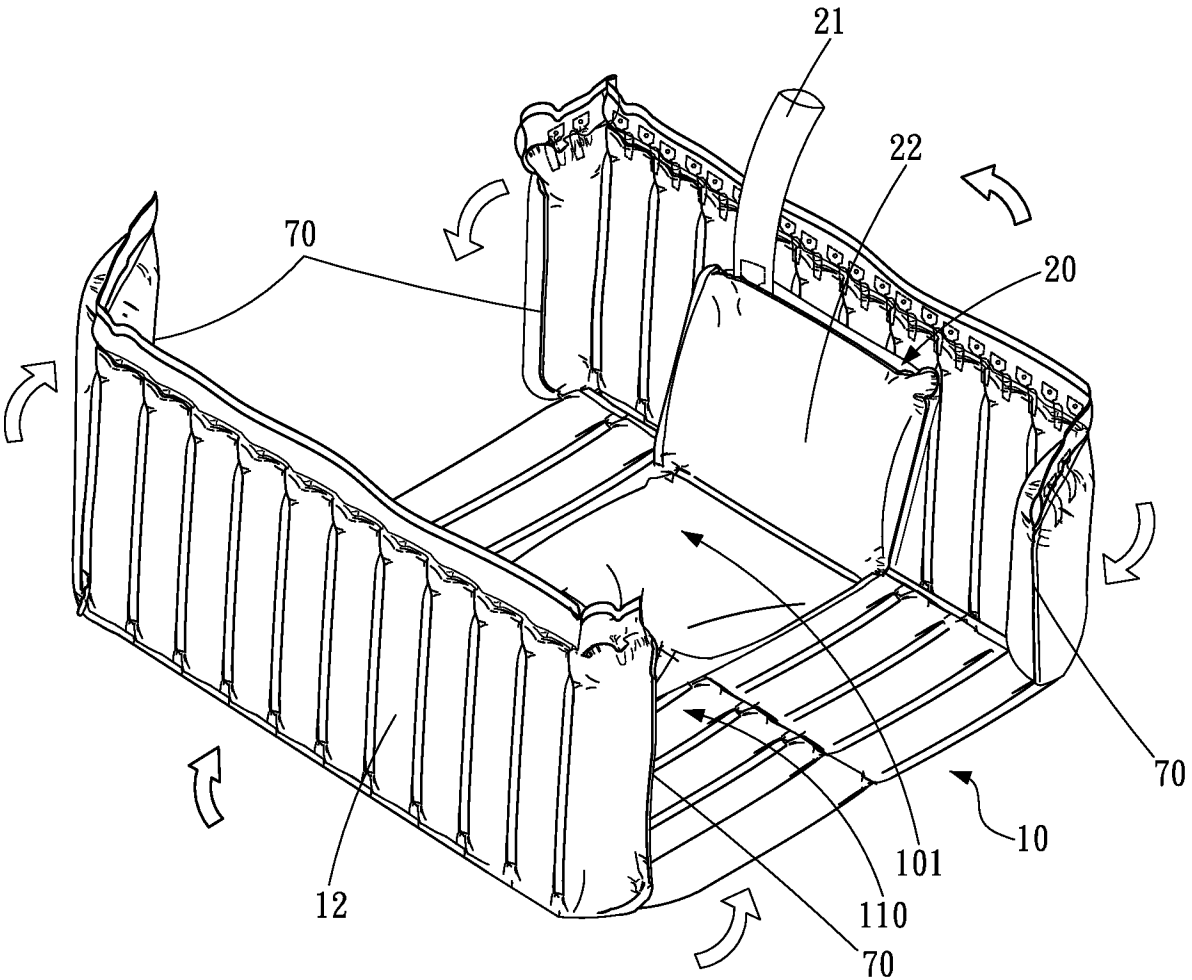
FIG. 2 is a perspective view of the first embodiment according to the present invention.
Figure 3:
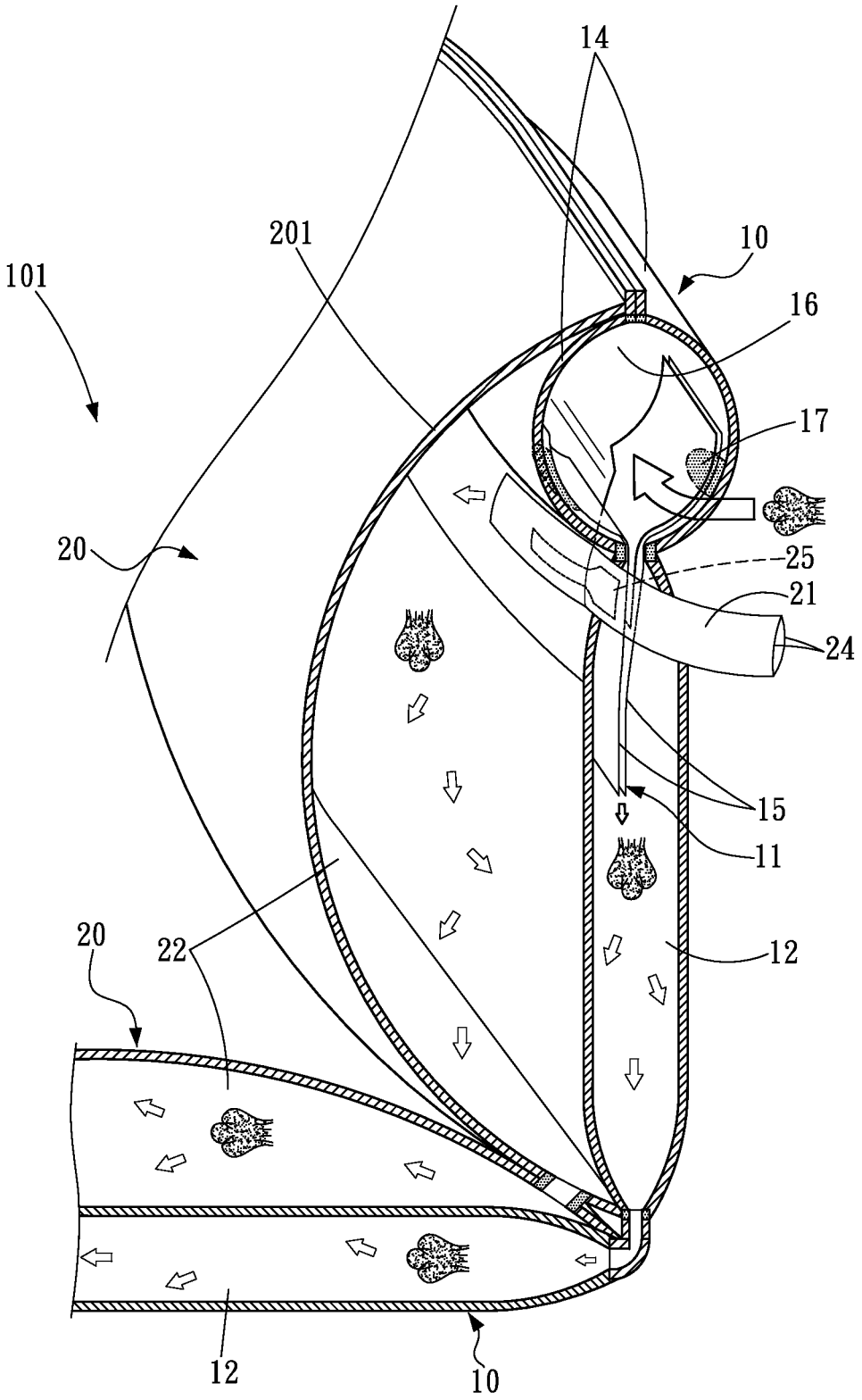
FIG. 3 is a cross sectional view of the first embodiment according to the present invention.

Please refer to FIGS. 1, 2 and 3, which show an air cylinder sheet and an adjustable air sac sheet of a first preferred embodiment according to the present invention.

Figure 6:
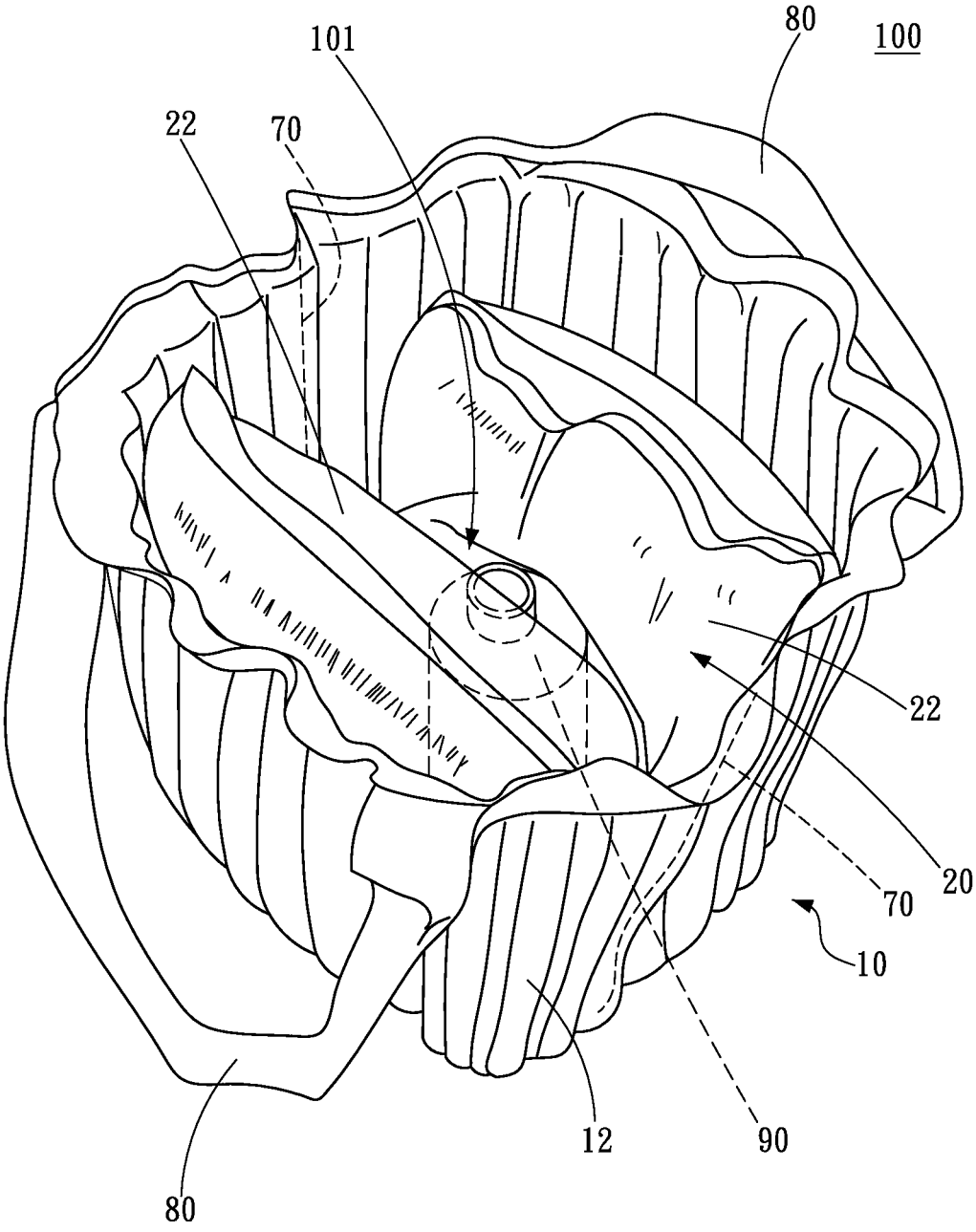
FIG. 6 is a perspective view of a third embodiment according to the present invention.
Figure 11:
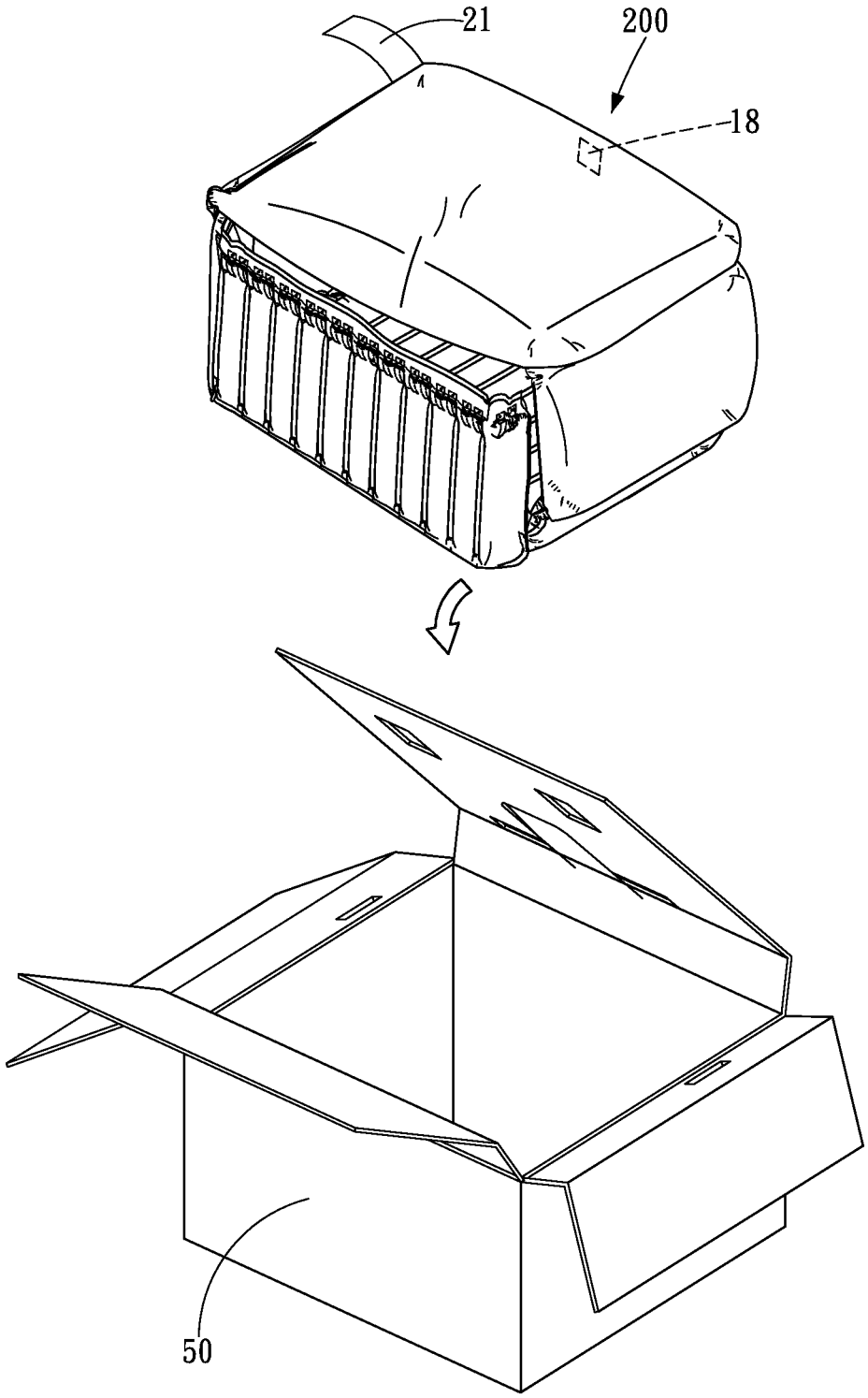
FIG. 11 is a perspective view of a fifth embodiment according to the present invention.

The present embodiment, as the figures show, includes an air cylinder sheet 10 and an adjustable air sac sheet 20, respectively being a plain sheet before air filling; they can be formed into a handbag as FIG. 6 shows or a cushioning structure 200 storable in a paper box 90 as FIG. 11 shows after air filling. The present invention takes the bag 100 formed after air filling as a descriptive example, but the present invention is not so limited.

The air cylinder sheet 10 includes a first air valve 11, a plurality of air cylinders 12 and a plurality of first nodes 13, where one end of the first air valve 11 is positioned in the plurality of air cylinders 12, guiding air to enter the plurality of air cylinders 12. The air cylinder sheet 10 has an containing portion 110 after being bent, and the plurality of first nodes 11 are respectively positioned on the plurality of air cylinders 12. The nodes 13 are arranged in pairs and spaced at intervals on each air cylinder 12, preferably, four pairs of first nodes 13 are positioned on each air cylinder 12. Based on this, the first nodes 13 on each two adjacent air cylinders 12 are also arranged correspondingly, allowing them to be aligned in a line approximately.

The adjustable air sac sheet 20 is formed of plastics. The adjustable air sac sheet 20 of the present embodiment includes a second air valve 21, where one end of the second air valve 21 is positioned in a cushioning adjustment zone 22, and another end thereof is positioned outside the cushioning adjustment zone 22, thereby providing independent air filling, but the present invention is not so limited. The adjustable air sac sheet 20 further includes the plurality of cushioning adjustment zones 22 connected to each other in sequence, which are positioned in the containing portion 110 and attached to the wall faces of the plurality of air cylinders 12. The adjustable air sac sheet 20 is bent with the air cylinder sheet 10 to have an accepting space 101. When a differently sized article 90 is placed in the accepting space 101, the adjustable air sac sheet 20 is filled with air to expand to clamp the object 90 tightly. The adjustable air sac sheet 20 in the embodiment having three cushioning adjustment zones 22 expanded by air filling is taken as a descriptive example, but the present invention is not so limited. The adjustable air sac sheet 20 further includes a plurality of second nodes 23, which are respectively positioned on the plurality of cushioning adjustment zones 22.

Please refer to FIG. 3, in which the adjustable air sac sheet 20 is one sheet of film 201, which is stuck to the inner face of the air cylinder sheet 10 by means of hot sealing, forming an independently air-storable air sac in a bag. The film 201 is stuck closely to the air cylinder sheet 10 from one upper end of the inner face of the air cylinder sheet 10, along the surroundings of the film 201 to the another upper end of the air cylinder sheet 10 by means of hot sealing to form an airtight body covering the inner face the air cylinder sheet 10. The structure and the coupling way of the adjustable air sac sheet 20 here are only explanatory and exemplary, the present invention is not so limited.

The longitudinal direction of the plurality of air cylinders 12 is preferably the same as the longitudinal direction of the adjustable air sac sheet 20, but the present invention is not so limited, the longitudinal direction of the plurality of air cylinders 12 may be perpendicular to the longitudinal direction of the adjustable air sac sheet 20, i.e. The both directions are different.

Please refer to FIG. 3, in which the air cylinder sheet 10 is a rectangular sheet structure approximately, formed by two sheets of first outer film 14 and two sheets of first inner film 15, where the two sheets of first outer film 14 are stacked vertically and stuck together to form the plurality of air cylinders 12 by means of hot sealing. The two sheets of first inner film 15 are positioned between the two sheets of first outer film 14, and stuck to each other to form the first air valve 11 between the two sheets of outer film 14 by means of hot sealing. Based on this, one end of the first air valve 11 is positioned in the air cylinders 12, and another end thereof is still positioned between the two sheets of outer film 14 and exposed outside the air cylinders 12. The portions of the first outer films 14 corresponding to the end of the first air valve 11 exposed out of the air cylinders 12 may further be stuck to each other to form an air filling passageway 16 at one side of the plurality of air cylinders 12 by means of hot sealing. Thereupon, the first air valve 11 is positioned between the air filling passageway 16 and the air cylinders 12 such that air can flow from the air filling passageway 16 to the air cylinders 12 via it.

Please refer to FIG. 3 again, in which the difference between the second air valve 21 of the adjustable air sac sheet 20 and the first air valve 11 of the air cylinder sheet 10 is that one end of the second air valve 21 is positioned in the cushioning adjustment zone 22, and another end thereof is exposed to the outside as FIGS. 2 and 11 show so as to be convenient for a user to carry out an air filling operation directly, thereby providing an air filling particular separated from the air cylinder sheet 10, i.e. the adjustable air sac sheet 20 has an independent air filling function, and the second air valve 21 stops air flowing out after air filling. The adjustable air sac sheet 20 is formed by sticking two sheets of first film 24 and two sheets of second inner film 25 together by means of hot sealing; the two sheets of first film 24 are stuck to each other by means of hot sealing to form the plurality of cushioning adjustment zones 22, and the two sheets of second inner film 25 are stuck to each other by means of hot sealing to form the second air valve 21. The type of the air valve 21 is the same as the one of the first air valve 11, the detailed description about it is omitted here.

Figure 5:
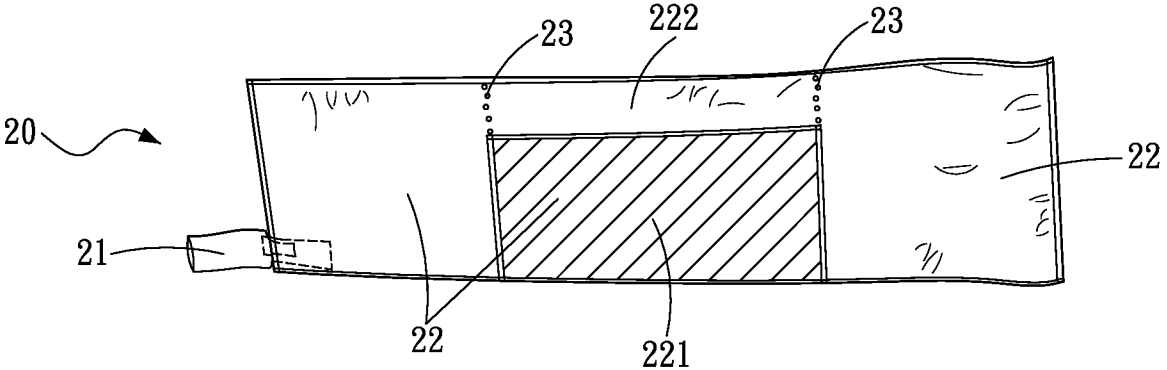
FIG. 5 is an another schematic view of an adjustable air sac sheet of the second embodiment according to the present invention.

Please refer to FIGS. 2 and 5, in which the air cylinder sheet 10 and the adjustable air sac sheet 20 are respectively bent along the firs nodes 13 and the second nodes 23 to form into an cubic structure approximately and hence the accepting space 101 for storing the object 90 after the air cylinder sheet 10 and the adjustable air sac sheet 20 are filled up with air.

Figure 7:
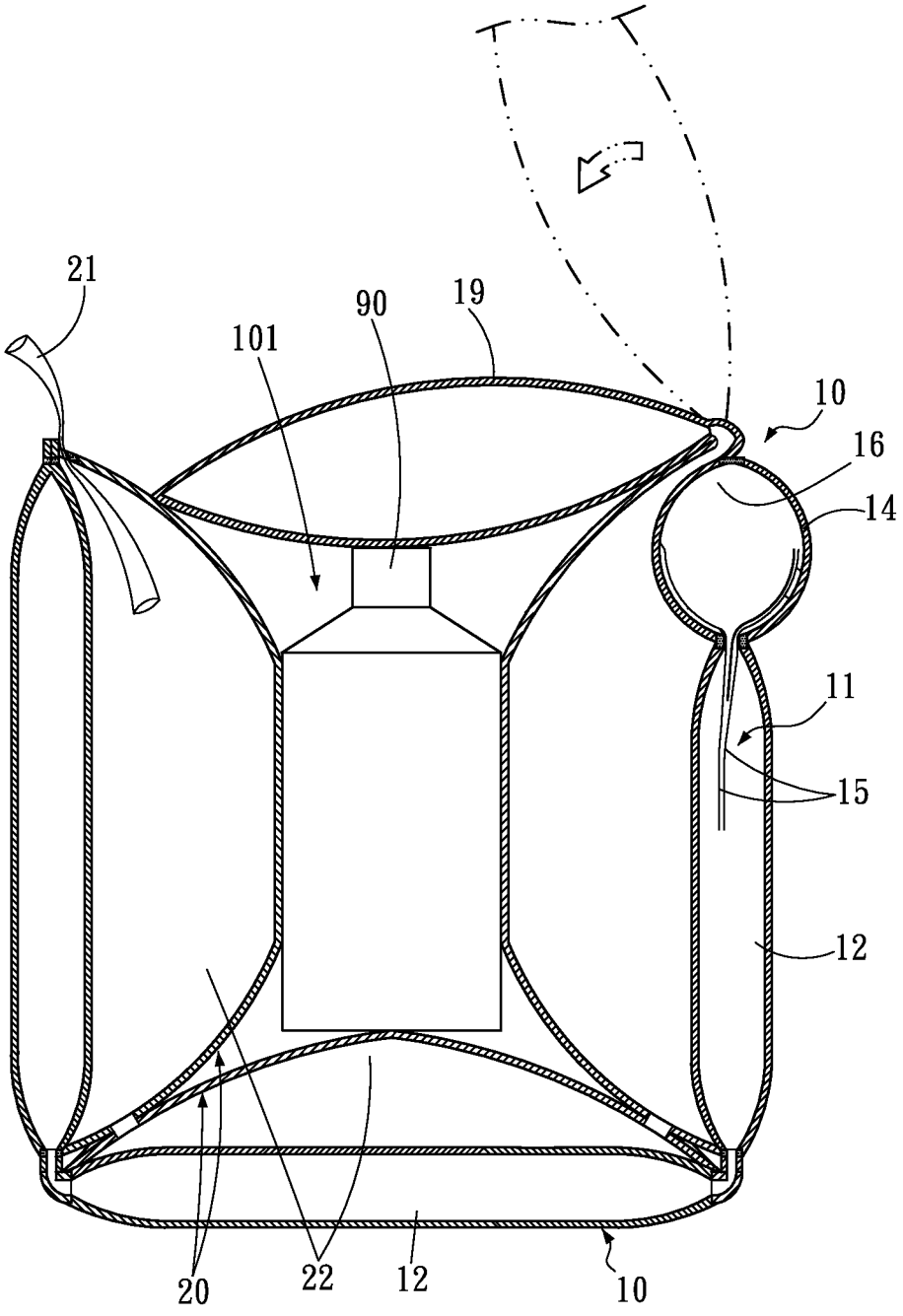
FIG. 7 is a cross sectional view of the third embodiment according to the present invention.

Air enters the adjustable air sac sheet 20 via the second air valve 21, causing the adjustable air sac sheet 20 to be filled with air and expanded. Since the expanded adjustable air sac sheet 20 will occupy a portion of the accepting space 101, the bigger a packed object 90 is, the larger the portion is occupied by the packed object 90, the adjustable air sac sheet 20 is expanded less to occupy the less portion of the accepting space 101. Vice versa, the smaller the packed object 90 is, the smaller the portion is occupied by the packed object 90, and the adjustable air sac sheet 20 is expanded more. Consequently, the expansion of the adjustable air sac sheet 20 can be adjusted with the size of the packed object 90, allowing the adjustable air sac sheet 20 to clamp the packed object 90 tightly in any situation as FIGS. 3 and 7 show.

Furthermore, the air cylinder sheet 10 has a plurality of hot sealing opening-closings 17 positioned in the air filling passageway 16 as FIGS. 1 and 3 show. Each pair of adjacent first outer film 14 and inner film 15 are stuck to each other by means of hot sealing, causing them to be coupled to each other. The air filling passageway 16 will be expanded, and the first outer films 14 will hence be pulled apart outward to drive the first inner films 15 to pull apart outward through the coupling of the first outer film 14 to the first inner film 15 after air enters the air filling passageway 16, thereby opening the first air valve 11, allowing the air in the air filling passageway to be filled into the air cylinders 12 via the first air valve 11, namely, the air cylinder sheet 10 can be filled with air and closes air automatically.

Please refer again to FIG. 3, in which the second air valve 21 is an approximately rectangular sheet structure formed by the two sheets of first film 24 and the two sheets of second inner film 25, where the two sheets of first film 24 are stacked vertically and stuck to each other to form a plurality of cushioning adjustment zones 22 by means of hot sealing. The two sheets of second inner film 25 positioned between the two sheets of first film 24 are stuck to each other by means of hot sealing to form the second air valve 21 between the two sheets of first film 24. Thereupon, one end of the second air valve 21 is positioned inside the cushioning adjustment zone 22, and another end thereof is still positioned between the two sheets of first film 24 and hence exposed out of the cushioning adjustment zone 22.

Figure 4:
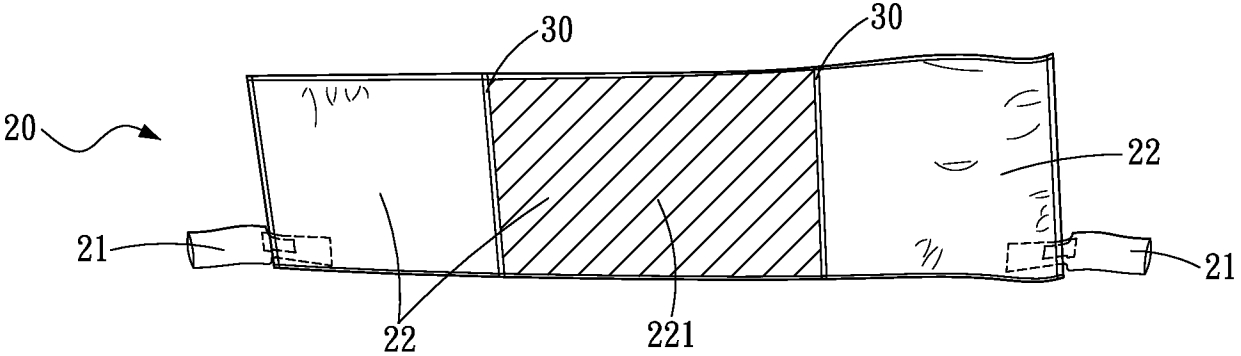
FIG. 4 is a schematic view of an adjustable air sac sheet of a second embodiment according to the present invention.

Please refer to FIGS. 4 and 5, in which the adjustable air sac sheet 20 itself has a plurality of second nodes 23, respectively positioned on the cushioning adjustment zones 22. The second nodes 23 are arranged on the cushioning adjustment zones 22 at space intervals, forming straight lines approximately, where the number of the straight lines formed by the second nodes 23 is two, thereby dividing the adjustable air sac sheet 20 into three parts along the longitudinal direction to form three air-expansible cushioning adjustment zones 22, or two air-expansible cushioning adjustment plus an air-inexansible zone between them. In the present embodiment, the two ends of the adjustable air sac sheet 20 respectively are the plurality of cushioning adjustment zones, and an air-inexpansible hermetically-sealed zone 221 collocated in between. Therefore, the hermetically-sealed zone 221 is thinner than other zones after air filling, thereby increasing use convenience through the collocation of the air-expansible and air-inexpansible zones. In addition, an air delivering channel 222 is further configured on one end of the air-inexpansible hermetically-sealed zone 221, in a manner that the cushioning adjustment zones can be in air communication with each other through the air delivering channel 222. In the description, the adjustable air sac sheet 20 may be divided into zones by hot-sealing the virtual lines of the air sac sheet 20 formed by the second nodes 23 depending on the outlook and size of an object; the divisions do not affect the air filling of the adjustable air sac sheet 20.

The air cylinder sheet 10 further includes a plurality of coupling elements 70, positioned on two side edges of the air cylinder sheet 10 as FIGS. 2 and 6 show. The plurality of coupling elements 70 are used to position each other when the air cylinder sheet 10 is bent into a bag 100. More specifically, the plurality of coupling elements 70 may be used to retain the two ends of the bag 100 through the positioning of the plurality of coupling elements 70 when the air cylinder sheet 10 and the adjustable air sac sheet 20 are bent into the bag 100 after the air cylinder sheet 10 and the adjustable air sac sheet 20 are filled with air.

The above coupling elements 70 may be used by means of hot sealing sticking; the coupling elements 70 may be formed as hot sealing lines or tear lines that can be torn conveniently. The coupling elements 70 may further be used by means of adhesion, allowing the bag 100 to be torn apart to return to a plain state for recycling. Furthermore, the air cylinder sheet 10 may further include a hand-strap, convenient for a user to carry the bag 100 after it is formed. Furthermore, the adjustable air sac sheet 20 may be coupled to the accepting space 101 of the bag 100 in the same direction as the plurality of air cylinders 12 to stack in the accepting space 101.

Please refer to FIG. 7, in which the air bag structure further includes a top cover 19. In the present embodiment, the top cover 19 is coupled to the air cylinder sheet 10, but the present invention is not so limited. The top cover 19 will be expanded with the air cylinder sheet 10 while the air cylinder sheet 10 is filled with air. Thereafter, the top cover 19 is further used to cover the opening at the upper side of the bag 100, thereby allowing the accepting space to be closed tightly and the object 90 in the accepting space 101 to be stored in the bag 100 stably.

Figure 8A:
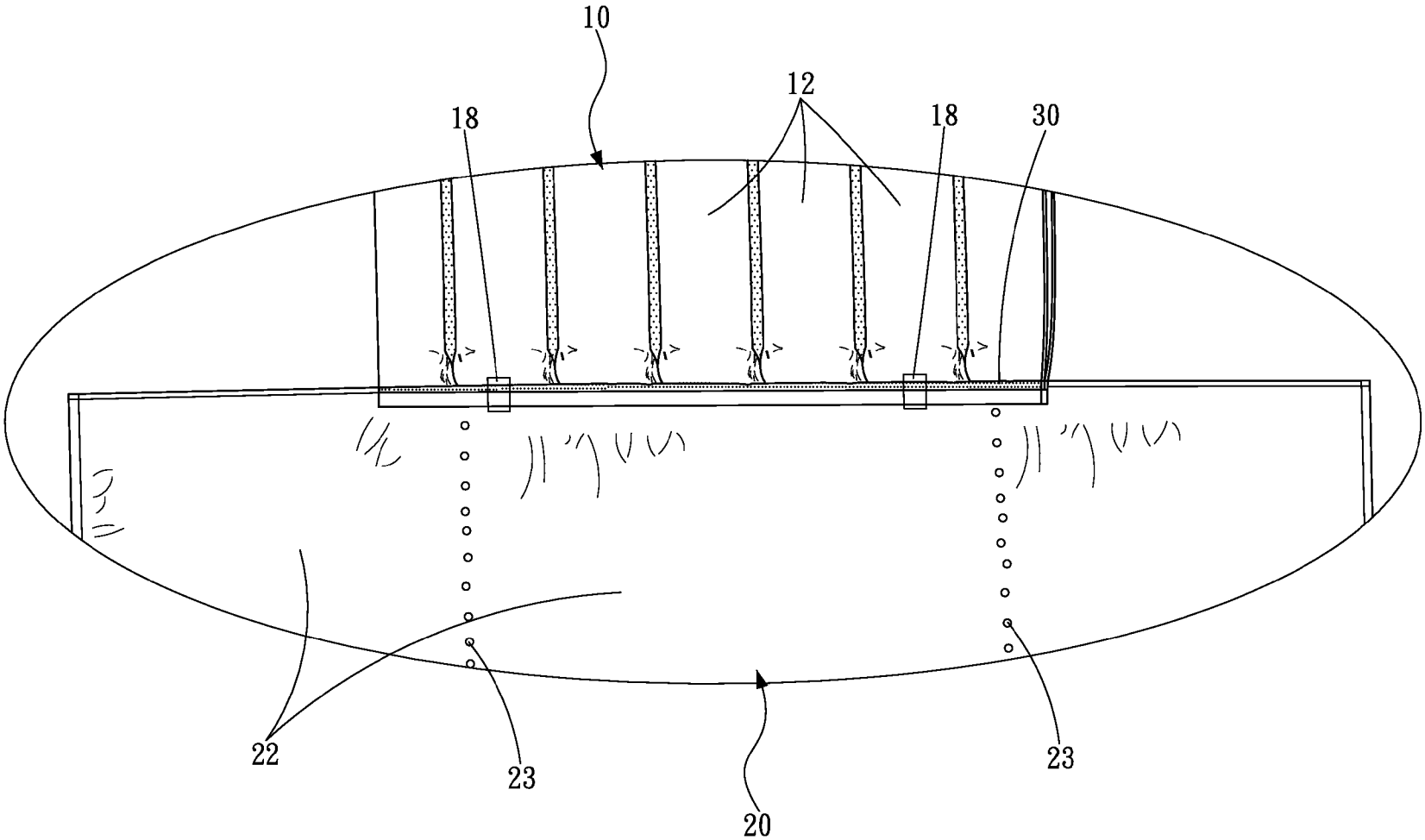
FIG. 8A is a partial enlarged view of a fourth embodiment according to the present invention.

Please refer to FIG. 8, which shows a fourth preferred embodiment of the present invention, the difference between the embodiment shown in FIG. 1 and the fourth embodiment is that the fourth embodiment includes coupling portions 30 (e.g. hot sealing line), opposite to the first air valve 11 and positioned on another side of the air cylinder sheet 10. The coupling portion 30 includes air pores 18, allowing the cushioning adjustment zones 22 to be in air communication with the air cylinders 12, and both the cushioning adjustment zones 22 and the air cylinders 12 to be filled up with air and expanded at a single air filling procedure.

To the first nodes 13 on the above air cylinder sheet 10, it is preferably that two pairs of first nodes 12 are positioned on each air cylinder 12 to divide the air cylinder 12 into three equal parts. Thereupon, the first nodes 13 positioned on each two adjacent air cylinders 12 also corresponds to each other, allowing them to form a straight line approximately. The air cylinder sheet 10 is stuck to the adjustable air sac sheet 20 along the coupling portions 30 while the air cylinder 10 is coupled to the adjustable air sac sheet 20, allowing the air cylinder sheet 10 and the air sac sheet 20 to form a T-shaped structure approximately.

Figure 8B:
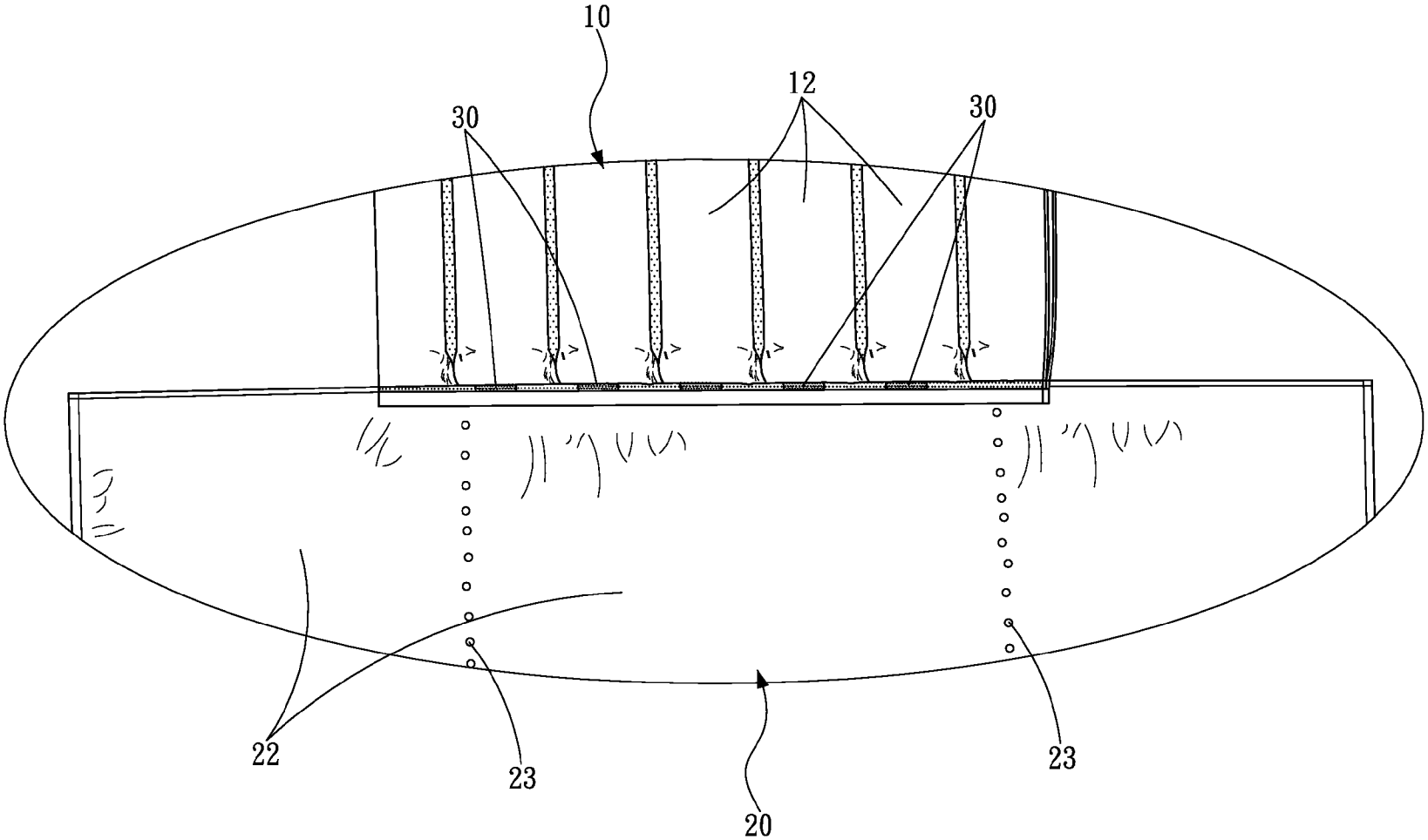
FIG. 8B is an another partial enlarged view of the fourth embodiment according to the present invention.

Thereupon, the coupling portions 30 is used to stick the cushioning adjustment zone and the air cylinders 12 to couple the adjustable air sac sheet 20 to the air cylinder sheet 10; the longitudinal axis of the air cylinders 12 is substantially perpendicular to the longitudinal axis of the cushioning adjustment zones 22, where the length of the coupling portion 30 is smaller than the width of the air cylinder 12, allowing the inner parts of the air cylinder to be stuck to each other and other parts thereof are left unstuck upon hot sealing so that the internal portions of the air cylinders 12 still can be in air communication with one another as FIG. 8B shows.

The air filling passageway 16 will be expanded after air enters the air filling passageway 16. Namely, the first outer films 14 will be pulled apart outward to drive the first inner films 15 to pull apart outward to open the first air valve 11 due to the coupling of the first outer film 14 to the first inner film 15, allowing the air in the air filling passageway 16 to be filled in the air cylinders 12 via the first air valve 11. The air in the air cylinders 12 forces the first air valve 11 to close. Furthermore, air is filled into the cushioning adjustment zone 22 via the second air valve 21, and the air in the cushioning adjustment zone 22 forces the second air valve 21 to close.

Figure 9:
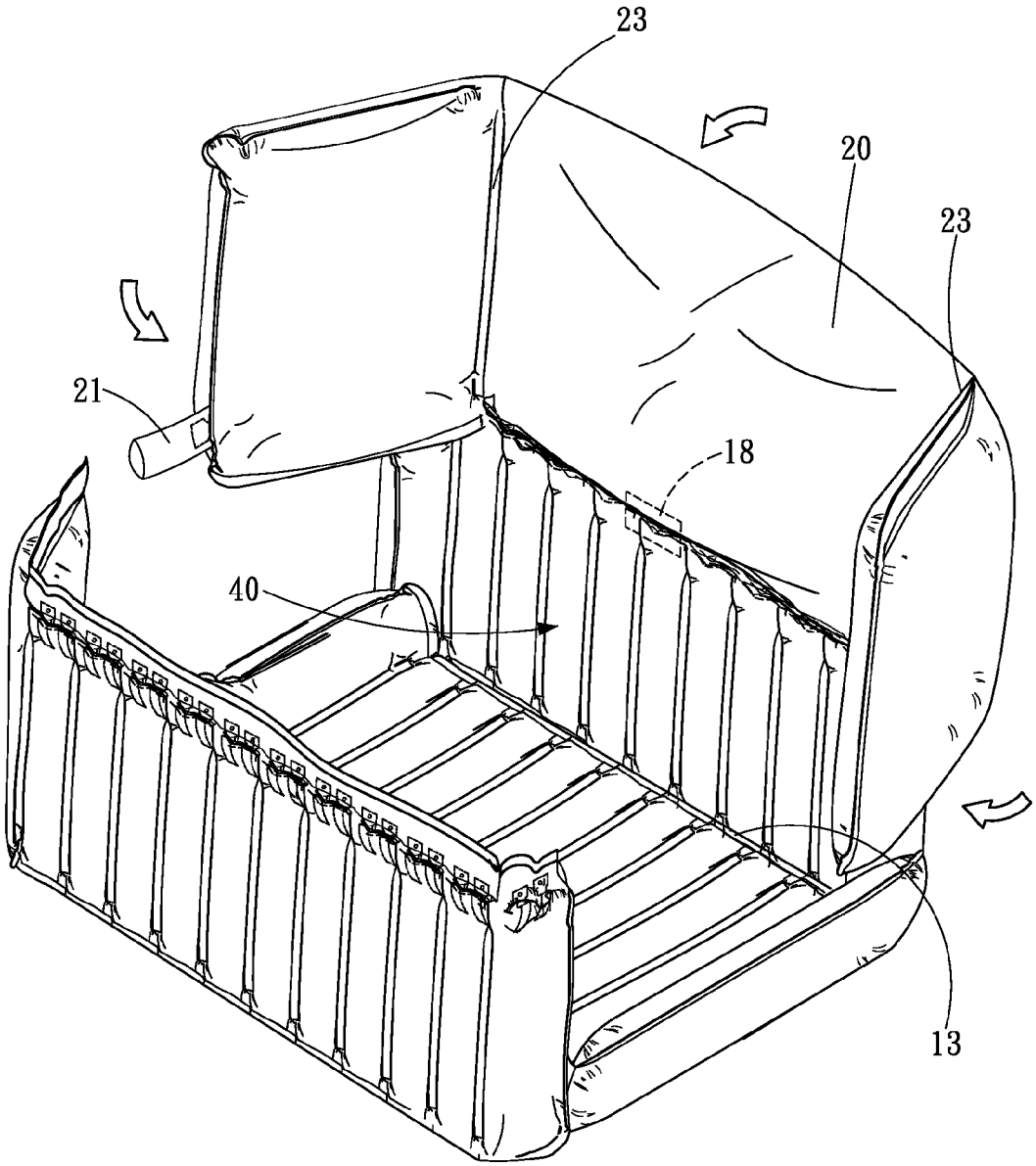
FIG. 9 is a perspective view of the fourth embodiment according to the present invention.

Please refer to FIG. 9, in which the air cylinder sheet 10 and the adjustable air sac sheet 20 are bent into a cubic structure approximately along the first nodes 13 and the second nodes, and hence to form an accepting space 40 to receive an object 90 after the air cylinder sheet 10 and the adjustable air sac sheet 20 in air communication with each other through the air pores 18 are filled up with air simultaneously. In the present embodiment, the adjustable air sac sheet 20 may be used as the top cover 19 of the third embodiment shown in FIG. 7. Similarly, it has an effect of covering the object 90.

Figure 10:
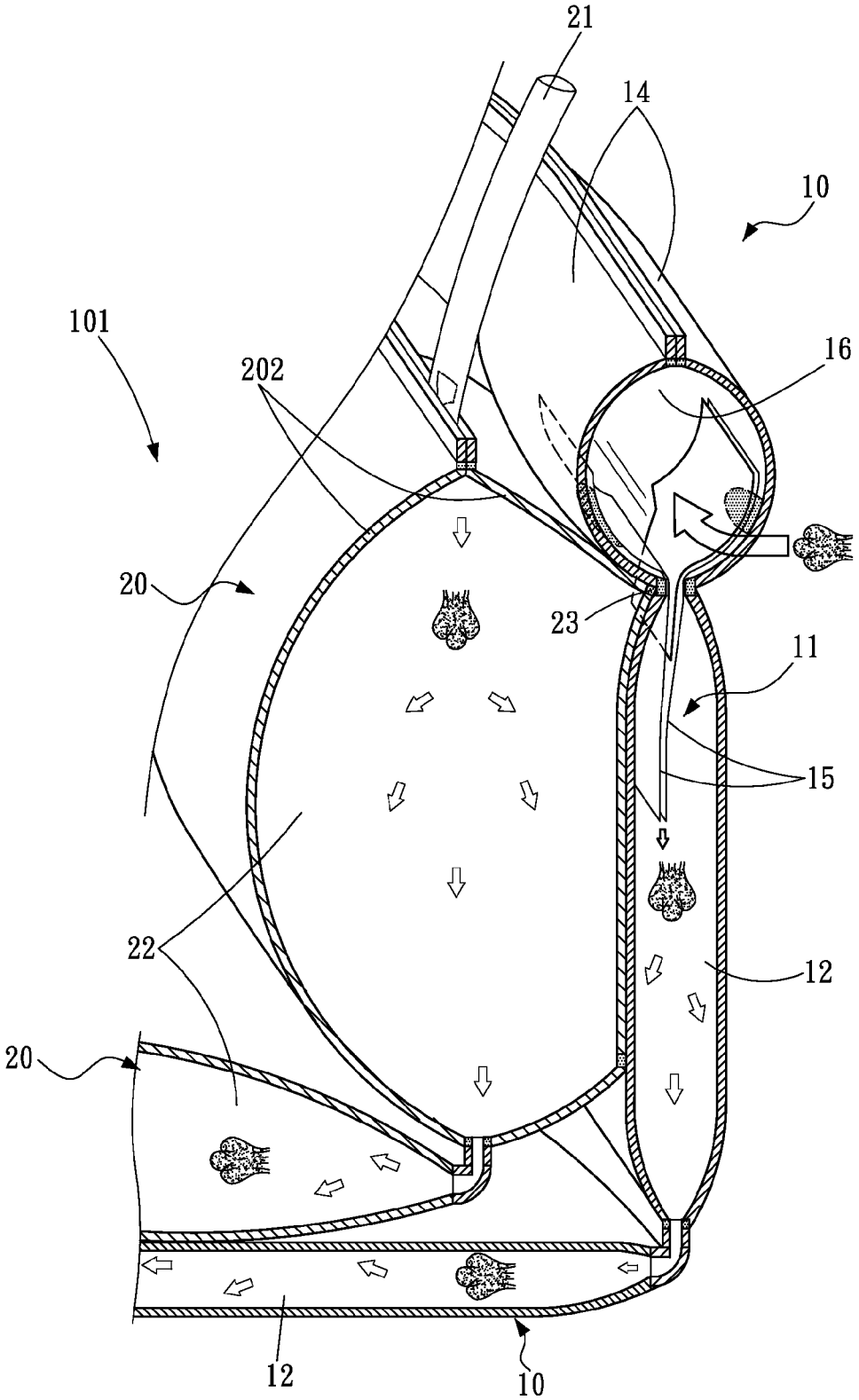
FIG. 10 is a cross sectional view of the fourth embodiment according to the present invention.

Please refer to FIG. 10, in which the difference between an exemplary embodiment show in FIG. 10 and the embodiment shown in FIG. 3 is that the adjustable air sac sheet 20 is formed by sticking two sheets of film 202 to the air cylinder sheet 10 by means of hot sealing, and the two sheets of film 202 are here used to increase the size of the adjustable air sac 20 after air filling and expansion, and hence reduce the accepting space 101 so as to clamp a much smaller object.

Figure 12:
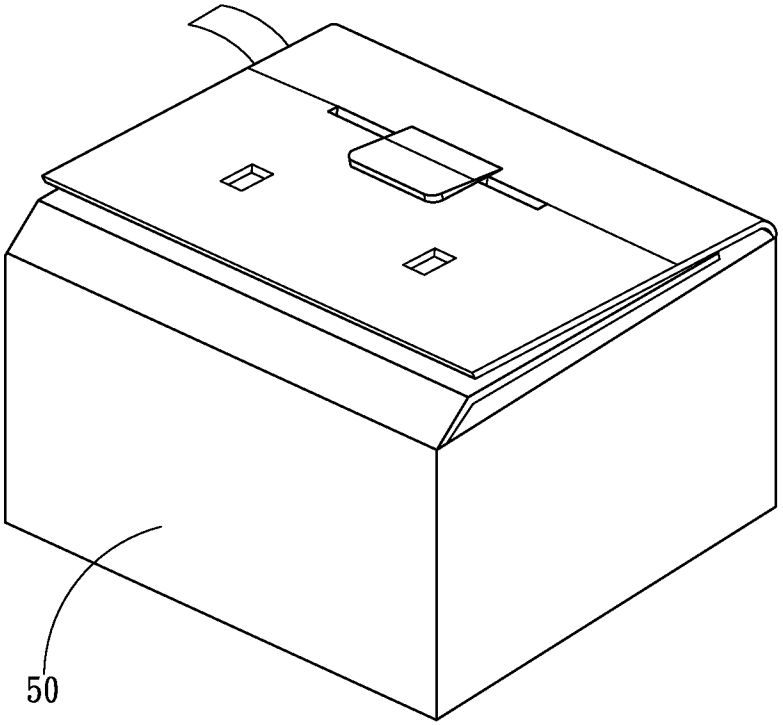
FIG. 12 is another perspective view of a fifth embodiment according to the present invention.

Please refer to FIGS. 11 and 12, in which the air cylinder sheet 10 and the adjustable air sac sheet 20 may further be bent into a cubic structure approximately, i.e. formed into a cubic air filling cushioning structure 200, and an object 90 is placed in the accepting space 101 of the air cushioning structure 200. Thereafter, the air cushioning structure 200 is placed in a paper box 50, thereby utilizing the air cushioning structure 200 to protect the object 90 from colliding with the paper box 50. The adjustable air sac sheet 20 coupled to the accepting space 101 of the air cushioning structure 200 may be completed by means of butting, and include the air pores 18 allowing the air cylinder sheet 10 to be in air communication with the adjustable air sac sheet 20. The plurality of independent air cylinders 12 of the accepting space 101 constitute three faces (e.g. left, middle lower and right sides), in the box, and the zones of the adjustable air sac sheet 20 further constitute other three faces (e.g. front, middle upper and rear sides), to cover the inner accepting space 101 completely and protect the object therein after the air cushioning structure 200 is placed in the paper box 50.

The present invention uses the plurality of air cylinders constituted outside to do the cushioning protection of the object 90, and may be formed into the handhold bag 100 or the cushioning structure 200 mounted in the paper box 90 for use. Taking the bag 100 as an example, the adjustable air sac sheet 20 formed of a plastic sheet is further configured in the bag. The air cylinder 10 and the adjustable air sac sheet 20 may be perspectively filled with air independently or may be filled with air by means of integral air communication. The adjustable air sac sheet 20 may adjust the internal pressure for clamping the object 90 automatically after air filling even if the expanded air cylinder sheet 10 is positioned outside the adjustable air sac sheet 20.

The coupling of the independent air cylinder sheet to the adjustable air sac sheet may be carried out by stacking them together, or by connecting the head portion or the tail portion of the air cylinder sheet with the adjustable air sac sheet, and the coupling way may be pure hot sealing without air communication or hot sealing with air communication, which may be carried out by not adhering inner plastic films to inner plastic films with blocking structures between them but adhering outer film to outer film at coupling points, the latter allows air to be communicated between the independent air cylinders and the air sacs connected with them; they can be filled up with air by only one time air filling.

The present invention may receive different sizes of objects through the accepting space of the adjustable air sac sheet after air filling, and uses the air cylinder sheet and adjustable air sac sheet to have double protection, capable of achieving the multiple packing bag specifications only by one single air bag structure, i.e. one single air cylinder sheet and one single adjustable air sac sheet can provide multiple different sizes of bag accepting spaces. In addition, the present can increase cushioning effect and the environmental protection effect of reducing the use of packing bags.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A cushioning air bag with automatically adjustable clamping pressure, comprising:

an air cylinder sheet, comprising a first air valve, and a plurality of air cylinders, one end of the first air valve being positioned in the plurality of air cylinders and guiding air to enter the plurality of air cylinders, the air cylinder sheet being bent to have a containing portion; and an adjustable air sac sheet, comprising a plurality of cushioning adjustment zones connected to each other, positioned on the containing portion and attached to wall surfaces of the plurality of air cylinders, the adjustable air sac sheet being bent with the air cylinder sheet to have an accepting space among the plurality of cushioning zones, the adjustable air sac sheet being filled with air and expanded to clamp an object when the object received in the accepting space, the adjustable air sac sheet having three air-expansible cushioning adjustment zones, or two air-expansible cushioning adjustment zones plus one air-inexpansible hermetically-sealed zone.

2. The cushioning air bag according to claim 1, wherein the air cylinder sheet is formed by sticking two sheets of first outer film and two sheets of first inner film by means of hot sealing, the two sheets of first outer film are stuck to each other by means of hot sealing to form the plurality of air cylinders, and the two sheets of first inner film are stuck to each other by means of hot sealing to form the first air valve.

3. The cushioning air bag according to claim 2, wherein the two sheets of first outer film are stuck to each other by means of hot sealing to form an air filling passageway positioned at one side of the plurality of air cylinders, the first air valve allows the air filling passageway to be in air communication with the plurality of air cylinders.

4. The cushioning air bag according to claim 3, wherein the air cylinder sheet comprises a plurality of hot sealing opening-closings positioned in the air filling passageway and sticking the two sheets of first outer film to the two sheets of first inner film adjacent thereto, wherein air enters the air filling passageway to cause the two sheets of first outer film to be pulled apart outward, and the plurality of hot sealing opening-closings hence drive the two sheets of inner film to pull apart outward to open the first air valve, allowing the air in the air filling passageway to be filled into the plurality of air cylinders via the first air valve.

5. The cushioning air bag according to claim 1, wherein a longitudinal axis of the adjustable air sac sheet is in a same direction as that of the plurality of air cylinders, the adjustable air sac sheet and the air cylinders being stacked up in the accepting space, or in a different direction than that of the plurality of air cylinders, the adjustable air sac sheet and the air cylinders being stacked up in the accepting space, the adjustable air sac sheet and the air cylinder sheet are placed in an outer paper box, the plurality of air cylinders are positioned on three faces of the paper box, and the adjustable air sac sheet are positioned on another three faces of the paper box.

6. The cushioning air bag according to claim 1, wherein the plurality of cushioning adjustment zones of the adjustable air sac sheet further comprises a second air valve, one end of the second air valve is positioned in another part of the plurality of cushioning adjustment zones.

7. The cushioning air bag according to claim 6, wherein the adjustable air sac sheet comprises two sheets of first film and two sheets of second inner film, the adjustable air sac sheet is formed by sticking together the two sheets of first film and the two sheets of second inner film by means of hot sealing, the two sheets of first film are stuck to each other by means of hot sealing to form the plurality of cushioning adjustment zones, the two sheets of second inner film are stuck to each other by means of hot sealing to form the second air valve.

8. The cushioning air bag according to claim 1, wherein a longitudinal axis of the plurality of air cylinders is in a direction parallel to a longitudinal axis of the adjustable air sac sheet.

9. The cushioning air bag according to claim 1, wherein the air cylinder sheet and the adjustable air sac sheet are coupled to each other through a coupling portion, the coupling portion comprises an air pore, allowing the plurality of cushioning adjustment zones to be in air communication with the plurality of air cylinders.

10. The cushioning air bag according to claim 1, wherein the adjustable air sac sheet has the two air-expansible cushioning adjustment zones plus the one air-inexpansible hermetically-sealed zone, the adjustable air sac sheet further comprising an air delivering channel on one end of the air-inexpansible hermetically-sealed zone, allowing the two air-expansible cushioning adjustment zones to be in air communication with each other for air filling.

11. The cushioning air bag according to claim 1, wherein the air cylinder sheet further comprises a plurality of coupling elements positioned on two side edges of the air cylinder sheet, the coupling elements being used to position each other while the air cylinder sheet is bent into a bag.

12. The cushioning air bag according to claim 11, further comprising a top cover coupled to the air cylinder sheet and used for covering the bag.

13. The cushioning air bag according to claim 1, wherein the adjustable air sac sheet has the three air-expansible cushioning adjustment zones.

14. The cushioning air bag according to claim 1, wherein the adjustable air sac sheet has two air-expansible cushioning adjustment zones plus one air-inexpansible hermetically-sealed zone.

15. A cushioning air bag with automatically adjustable clamping pressure, comprising:

an air cylinder sheet, comprising a first air valve, and a plurality of air cylinders, one end of the first air valve being positioned in the plurality of air cylinders and guiding air to enter the plurality of air cylinders, the air cylinder sheet being bent to have a containing portion; and an adjustable air sac sheet, comprising a plurality of cushioning adjustment zones connected to each other, positioned on the containing portion and attached to wall surfaces of the plurality of air cylinders, the adjustable air sac sheet being bent with the air cylinder sheet to have an accepting space among the plurality of cushioning zones, the adjustable air sac sheet being filled with air and expandable to separately clamp each of a plurality of differently sized articles within the accepting space, the adjustable air sac sheet having three air-expansible cushioning adjustment zones, or two air-expansible cushioning adjustment zones plus one air-inexpansible hermetically-sealed zone.

16. The cushioning air bag according to claim 15, wherein the adjustable air sac sheet has the three air-expansible cushioning adjustment zones.

17. The cushioning air bag according to claim 15, wherein the adjustable air sac sheet has two air-expansible cushioning adjustment zones plus one air-inexpansible hermetically-sealed zone.

* * * * *